US006874244B2

(12) United States Patent
Birrer et al.

(10) Patent No.: US 6,874,244 B2
(45) Date of Patent: Apr. 5, 2005

(54) ELEVATOR INSTALLATION WITH A MEASURING SYSTEM FOR DETERMINING ABSOLUTE CAR POSITION

(75) Inventors: Eric Birrer, Lucerne (CH); Heiko Essinger, Rielasingen (DE); Frank Müller, Dortmund (DE)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 10/767,653

(22) Filed: Jan. 29, 2004

(65) Prior Publication Data

US 2004/0216320 A1 Nov. 4, 2004

Related U.S. Application Data

(63) Continuation of application No. PCT/CH02/00406, filed on Jul. 22, 2002.

(51) Int. Cl.[7] ..... B66B 1/34; B66B 3/00

(52) U.S. Cl. ..... 33/708; 33/706; 187/294

(58) Field of Search ..... 33/1 L, 1 N, 1 PT, 33/706, 707, 708, DIG. 1, 762, 763; 187/283, 312, 391, 392, 393, 394, 397, 399

(56) References Cited

U.S. PATENT DOCUMENTS

| | | | | |
|---|---|---|---|---|
| 4,631,519 A | | 12/1986 | Johnston | |
| 4,786,891 A | * | 11/1988 | Ueda et al. | 33/707 |
| 5,023,434 A | | 6/1991 | Lanfer et al. | |
| 5,135,081 A | | 8/1992 | Watt et al. | |
| 5,798,490 A | * | 8/1998 | Vairio et al. | 187/394 |
| 5,821,477 A | * | 10/1998 | Gerstenkorn | 187/394 |
| 5,925,859 A | * | 7/1999 | Miller et al. | 187/394 |
| 6,018,881 A | * | 2/2000 | Spies | 33/708 |
| 6,435,315 B1 | * | 8/2002 | Zaharia | 187/394 |
| 2004/0174161 A1 | * | 9/2004 | Tausch et al. | 187/394 |

FOREIGN PATENT DOCUMENTS

| | | |
|---|---|---|
| DE | 42 09 629 | 10/1992 |
| DE | G 92 10 996.9 | 10/1992 |

* cited by examiner

*Primary Examiner*—G. Bradley Bennett
*Assistant Examiner*—Madeline Gonzalez
(74) *Attorney, Agent, or Firm*—Butzel Long

(57) ABSTRACT

An elevator car position measuring system includes a strip having a code mark pattern mounted near the elevator car and parallel to a travel direction, a code reading device mounted on the elevator car for contactless scanning of the code mark pattern and an evaluating unit connected to the code reading device for evaluating the scanned code mark pattern. A code word is formed by "n" successive code marks of the code mark pattern, a plurality of different ones of the code words are unambiguously arranged in an n-digit pseudo random sequence, the code words form a single-track of the code mark pattern and each of the code words represents an absolute car position. A floor sensor mounted on the elevator car detects position markings at floor levels along the travel direction and is connected to the evaluating units for evaluating the detected position markings against said scanned code words.

16 Claims, 6 Drawing Sheets

7
13
2λ
28
8
29
11
36
49
20
10
24
λ
22
0 0 1 0 0 1 1 1 1 0 0 1 1 0 1 0 0 0
21
23
12
46
47
33
Analog Signal Processing
0010011110011101000
Interpolation
μ-Controller
19
17
40
53
0001011101000010001100 10
35
52

ELEVATOR INSTALLATION WITH A MEASURING SYSTEM FOR DETERMINING ABSOLUTE CAR POSITION

This application is a Continuation of PCT/CH02/00406 filed July 22, 2002.

BACKGROUND OF THE INVENTION

The present invention relates to an elevator installation with a measuring system for determining the absolute car position of an elevator car movable along at least one guide rail.

In elevators, the positional information is applied in coded form in stationary position along the entire travel path of the elevator car and is read off in coded form by means of a code reading device and passed on to an evaluating unit. The evaluating unit prepares the read-off coded positional information to be comprehensible by a control and derives therefrom data signals which are passed on to the elevator control as so-termed shaft data.

An absolute measuring system with high resolution for determination of the relative position of two parts movable relative to one another is known from the German patent document DE 42 09 629 A1. In hitherto conventional manner, an absolute code mark pattern in the form of a gapless sequence of equal-length code marks of a pseudo random coding are formed there at a first part in a first track and an incremental code symbol pattern is formed there in a second track parallel thereto. In the absolute code mark pattern, any "n" successive code marks in each instance represent a code word. Each of these code words is present only once in the entire code mark pattern. A code reading device, which can detect "n" successive code marks all at once in a movement direction and in that case scans the incremental code symbol pattern, is provided at a second part movable relative to the first part. If the code reading device is moved along the first part by one code mark position of the absolute code mark pattern, a new n-digit binary code word is read.

In this known device each code word of the absolute code mark pattern defines a specific position of the two parts relative to one another. The length, which is measured in the direction of movement or reading, of the individual code marks and the number of the maximum possible code words establish the maximum length of the measuring path able to be addressed by code words. The resolution capability by which the relative position, i.e. the so-termed position code, expressed in the pseudo random code can be measured depends on the length of each individual code mark. The smaller the length of the code marks, the more accurate the positioning can be. However, reading-off becomes noticeably more difficult with decreasing lengths of the code marks, particularly in the case of high relative speeds.

In the case of use of such an absolute length measuring system for determining the position of a elevator car, such as, for example, the elevator known from German Utility Model G 92 10 996.9, the entire travel path in the travel direction of the elevator car is to be addressed in a gapless manner with coded position details, i.e. the code words of the pseudo random coding. The maximum of the measuring or travel path extent is then, however, limited by the sum of the length of all code marks. A pseudo random coding with multi-digit code words and/or code marks of greater length accordingly has to be provided for long travel paths. However, multi-digit code words necessitate correspondingly complicated code reading devices and evaluating units and this is connected with high costs. With increasing length of the individual code marks, however, the resolution capability diminishes.

In order to avoid errors in reading, the absolute code mark pattern and the incremental code symbol pattern are to be represented in their relative position exactly aligned with one another. This makes the production of a double-track code carrier expensive and moreover necessitates a time-consuming precise mounting. In addition, the code reading device, in particular, of a double-track absolute position measuring system is of large construction, which is undesirable with respect to the limited shaft cross-sectional area available. Furthermore, the travel speed in the case of double-track measuring systems is limited, which is felt to be limiting especially for elevators with large conveying heights.

SUMMARY OF THE INVENTION

An object of the present invention is to provide an elevator with a measuring system for determining the absolute position of the elevator car, which enables a high-resolution in the position recognition over a long travel path of the elevator car with the smallest possible expenditure.

According to the present invention this object is met by an elevator with an absolute position measuring system, which is distinguished particularly by the fact that the absolute code mark pattern and the incremental code symbol pattern are represented as a single-track, combined code mark pattern of n-digit pseudo random sequence in Manchester coding and the code reading device comprises sensors for scanning "n+1" successive code marks, wherein each second code mark of the single-track, combined mark pattern is scanned.

The essence of the present invention consists in a single-track coding for an absolute length measuring system in which starting from a binary n-digit pseudo random sequence, by which "$2^n-1$" different position values are coded, a "1" is inserted behind each "0" and a "0" is inserted behind each "1". The thereby obtained sequence according to the invention with double length represents quasi a combination of the n-digit pseudo random coding and a Manchester coding. So that all code words arising in the combined code mark pattern according to the invention differ from one another, "n+1" code marks of the respective second code marks of the combined code mark pattern have to be scanned.

The advantages of absolute single-track systems are combined, by the coding according to the present invention, with the advantage of the high resolution of the absolute double-track or multiple-track systems.

By the combined coding according to the present invention there can be represented, by an n-digit pseudo random coding with unchanged resolution, a measuring path twice as long as that corresponding with the sum of the lengths "$\lambda$" of all code marks of the n-digit pseudo random coding from which it is derived. In that case, exclusively individual code marks with the length "8" and code marks of the length "$2\lambda$" arise in the single-track, combined code mark pattern according to the present invention. Consequently, a code mark change takes place at the most after the length of "$2\lambda$" and can be detected or scanned by means of the code reading device. A scanning signal, by which the sensors for detection of the single-track positional code are controlled in drive, is derived from the quasi-equidistant code mark changes. The reading then always takes place when the sensors are disposed completely in coincidence with the code marks to be read. The single-track code mark pattern is slender and accordingly requires only a small attachment area along the travel path. In addition, a single-track code carrier can be produced simply and economically.

By merely one additional reading-off point of the code reading device, thus only "n+1" reading-off points, an unambiguous or absolute symbol pattern can be read off each time at the single track, according to the present invention, of the combined code mark pattern.

The code reading device with, in accordance with the present invention, only "n+1" reading points is economic and is of relatively small construction by comparison with conventional code reading devices for the same travel path extent and comparable resolution. For reading off the single-track, combined code mark pattern the sensors are arranged in movement direction on a line at a mutual spacing of "2λ", whereby the code reading device is formed to be slender and thus can be movably arranged in space-saving manner laterally adjacent to the guide rail.

In simple manner, even at start up and without travel of the elevator car, the absolute position thereof can be determined in that for each bit of the combined code mark pattern two sensors are arranged in travel direction at a spacing of half the code mark lengths. If one of the two sensors is disposed in the vicinity of a code mark change and delivers a sensor voltage of approximately the value zero, then the respective other sensor is, with certainty, disposed in coincidence with a code mark and delivers reliable information. The first sensors and the second sensors are, for absolute reading, in each instance combined into respective sensor groups. From the two interengaging sensor groups offset by half the code mark length, alternately always only the output signals of the sensors of one of the two sensor groups are selected for reading-off and evaluation. The switching over to the respective correct one of the two sensor groups is carried out by way of determination of the position of the transition between two different code marks and the two sensor groups by the scanning signal.

In the case of use of the single-track, combined coding according to the present invention in a magnetic measuring system the suppression of small magnetic poles by adjacent large magnetic poles, i.e. the so-termed inter-symbol interference, is reduced. This has a positive effect on the reading reliability in the case of a greater spacing of the code reading device from the code mark pattern. The spacing of the code reading device from the combined code mark pattern can thus be selected to be larger in the case of a larger magnetic measuring system. The measuring system is thus less susceptible to dirtying of the code carrier and occurring movements of the code reading device relative to the code mark pattern in a direction perpendicular to the reading or travel direction of the car. The uniform length of the code marks additionally enables a quick evaluation by economic components operating in parallel.

In a preferred embodiment, as a magnetic measuring system simple and economic Hall sensors are exclusively used for scanning the linear position code. Equally, Hall sensors of an interpolation device serve for determining the position of the transition between two different code marks —the zero transition of the magnetic field —relative to the sensor strip. The interpolation device is arranged in the travel direction over a region with a length greater than the length of two code marks "2λ". Spacing between these Hall sensors is smaller than the length "λ" of one code mark.

Moreover, in a particularly preferred development of the present invention it is proposed to use, additionally to the Hall sensors, an MR (magnetoresistive) sensor by which the coding according to the present invention is scanned and thus the resolution relative to previous absolute single-track systems is substantially increased. By virtue of the described characteristics, a combined code mark pattern with magnetic code marks externally forms a magnetic field with a path which is composed of approximately sinusoidal half-waves. These half-waves each have the length "λ" of one code mark or the length "2λ" of two code marks. When scanning with an appropriate MR sensor, there can be produced, by arctangent interpolation of the sensor voltages, a high-resolution position value which in each instance is travel-proportional within a pole. In combination with the absolute position value with the resolution of a code mark length, a high-resolution absolute position results.

A particularly reliable measuring system for determining the absolute car position can be obtained if the code reading device for scanning the position code is constructed, inclusive of the evaluating unit, in a redundant manner. The second code reading device is in that case constructed to be basically the same as the first code reading device and differs only by an arrangement of the intermediate reading unit and the fine interpolation in this sequence behind —in the travel direction —the position code reading unit. The sensor pairs of the two position code reading devices are arranged in a line, which is parallel to the direction of reading, to be offset relative to one another by a code mark length "λ" and to interengage. The code reading device is of compact construction and is longer than a measuring system of non-redundant construction merely by the interpolation device and the fine interpolation device.

A separate evaluating unit is associated with each of the two code reading devices, so that the output signals of the sensors of the two code reading devices are evaluated independently of one another and are available for the control of the elevator.

The redundant construction of the single-track measuring system additionally fulfils applicable safety requirements in the elevator industry and thus offers the possibility of replacing previous mechanically executed safety devices by electrical safety devices. Moreover, it is the basis, together with a respective floor sensor for each of the two measuring systems, of a comprehensive shaft information system which is illustrated schematically in FIG. 7. One of the floor sensors is associated with each evaluating unit. The floor sensors are moved in the shaft together with the elevator car in order to detect position markings arranged in the shaft at each floor level. These signals are processed together with the output signals of safety devices, which are similarly provided in redundant manner, in common with the positional information and serve for control of the elevator installation.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
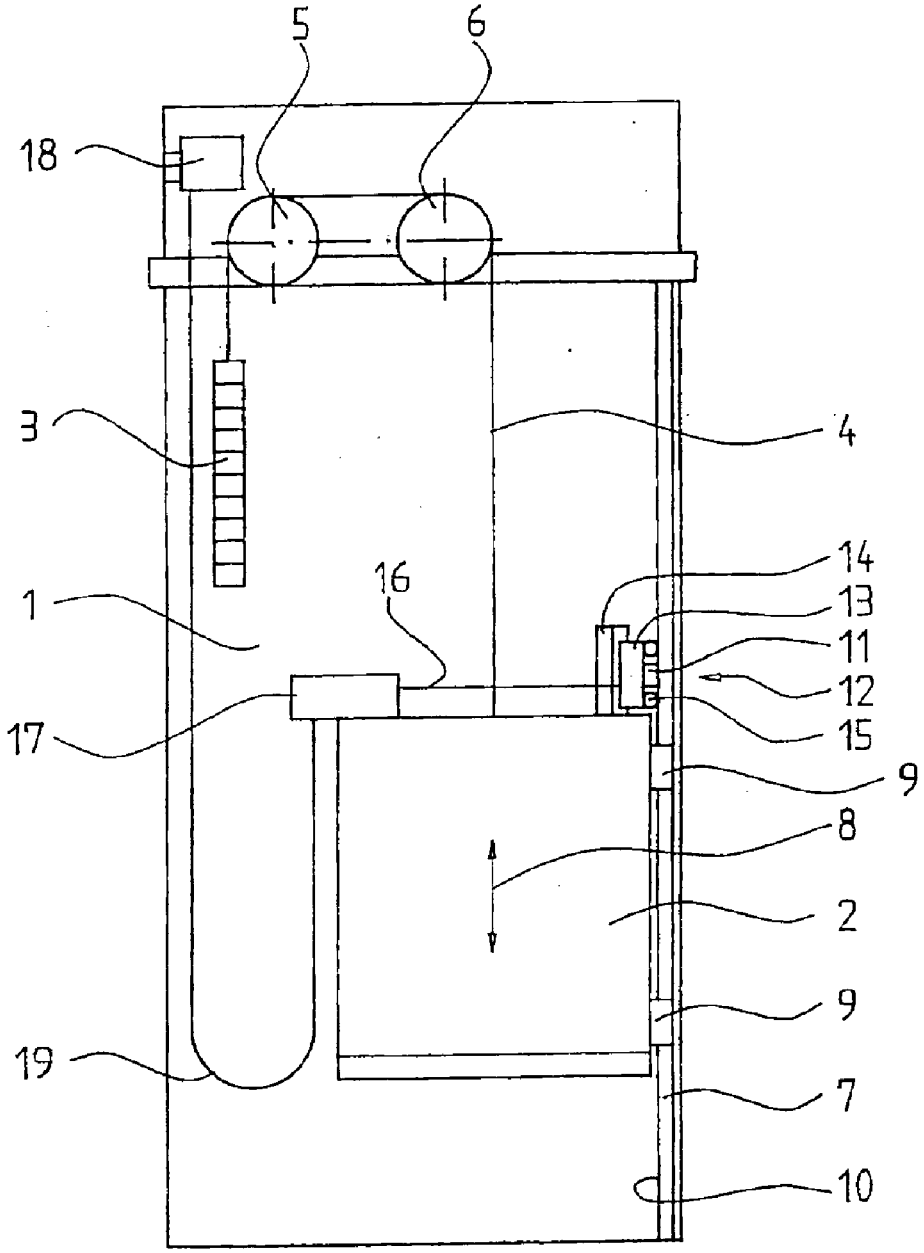
FIG. 1 is a schematic illustration of an elevator installation with a measuring system for determining the position of an elevator car in accordance with the present invention.

In an elevator installation —which is schematically illustrated in FIG. 1 —with an elevator shaft 1, an elevator car 2 and a counterweight 3 are suspended at several support cables, of which a single support cable 4 is illustrated here as representative. The support cables 4 run over a deflecting roller 5 and are guided over a driven drive pulley 6. The drive pulley 6 is driven by a drive motor (not shown) to transmits the drive forces of the drive motor to the support cables 4 for raising and lowering the counterweight 3 and the elevator car 2 along a guide rail 7. Guide shoes 9 fixedly connected with the elevator car 2 serve, in a travel direction 8, for guidance of the elevator car 2 at the guide rail 7 in a direction perpendicular to the travel direction 8. A magnetic strip 10 is mounted in stationary location at the guide rail 7 along the entire travel path of the elevator car 2 and parallel to the travel direction 8 of the elevator car 2. The magnetic strip 10 serves as a carrier for a single-track, combined code mark pattern according to the present invention, which pattern represents the numerical codes of absolute positions of the elevator car 2 in the shaft 1 in relation to a zero point.

A code reading device 12 is fixedly mounted on a top of the elevator car 2 and is aligned in the travel direction 8. The device 12 essentially consists of a sensor block 13 which carries a code reading sensor system 11 and which is mounted by a mount 14 to be displaceable perpendicularly to the travel direction 8. A roller guide 15 guides the sensor block 13 at the guide rail 7 when the code reading device 12 is moved together with the elevator car 2. The same arrangement is also possible mounted laterally or below the elevator car 2.

The code reading device 12 transfers the read-off coded information by way of connecting lines 16 to a car-mounted evaluating unit 17. The evaluating unit 17 translates the read-off coded information into an absolute position statement, which is comprehensible for an elevator control 18 and expressed in binary terms, before it is passed on by way of a depending cable 19 to the elevator control 18, for example for the positioning of the elevator car 2. Thus, the code reading device 12 and the evaluating unit 17 form a car position measuring system.

Figure 2:
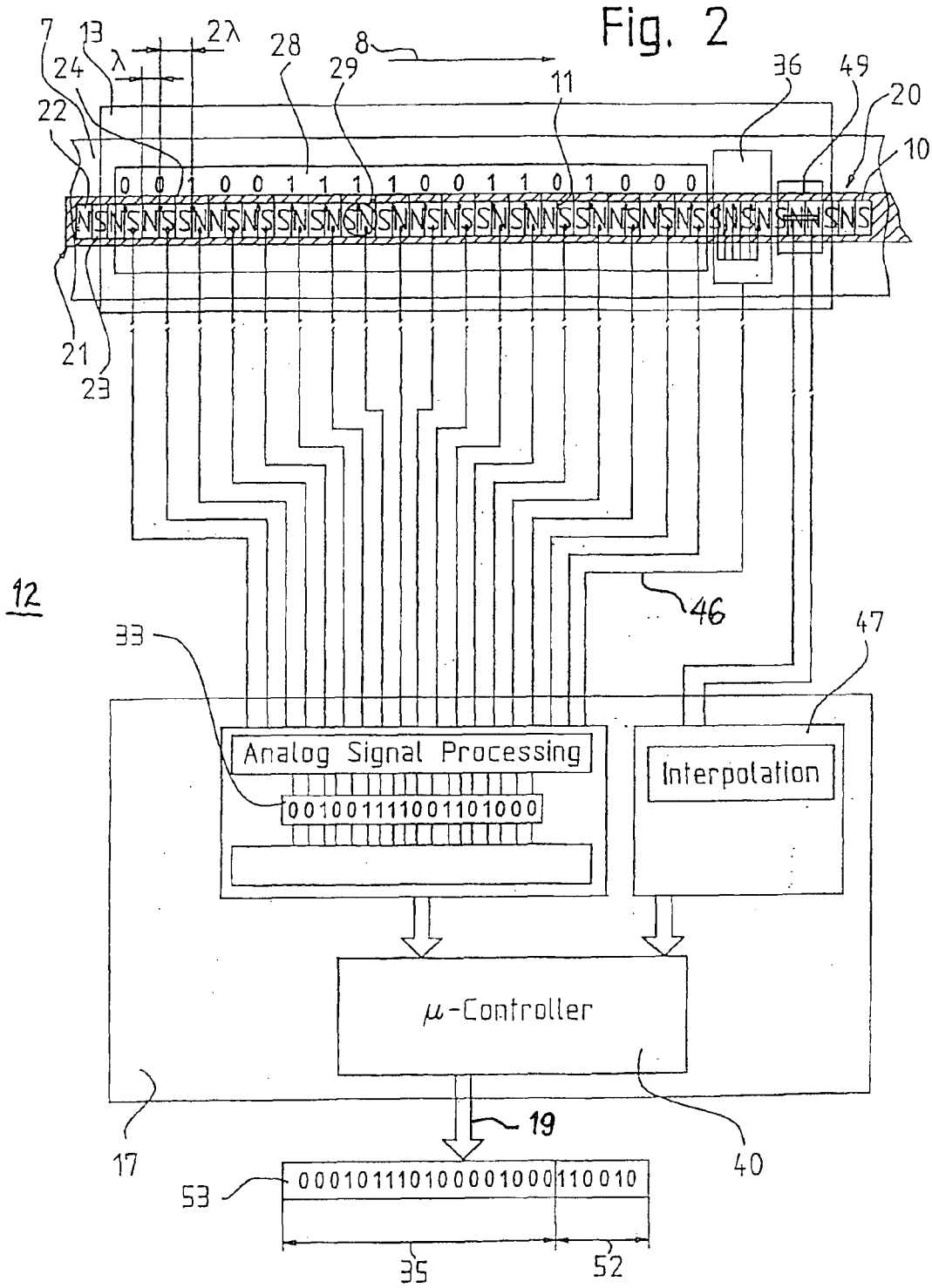
FIG. 2 is a schematic block diagram of a first embodiment of the measuring system shown in FIG. 1.

FIG. 2 schematically shows a first embodiment of the code reading device 12 according to the present invention with a magnetic measuring system. The magnetic strip 10 with a single-track, combined code mark pattern 20 is mounted on a section of the guide rail 7. Code marks 21 are symbolized by equal-length rectangular sections, which are arranged in a track in the longitudinal direction of the magnetic strip 10 and which each have a length of "λ=4 mm" and are magnetized either as a magnetic north pole 22 or as a magnetic south pole 23. The individual north poles 22 and south poles 23 form external correspondingly oriented magnetic fields. In each instance, two mutually adjacent code marks 21 define a so-termed bit of the coding. If a north pole 22 is disposed in front of a south pole 23 in the travel direction 8, then the value "0" is associated with this bit, whilst the value "1" is associated with a south/north transition. This form of weighting, which is defined by way of state changes, of the bits is known as a so-termed Manchester coding. For clarification, the corresponding binary numbers or bits are recorded in FIG. 2 above individual pole transitions 24.

Figure 3:
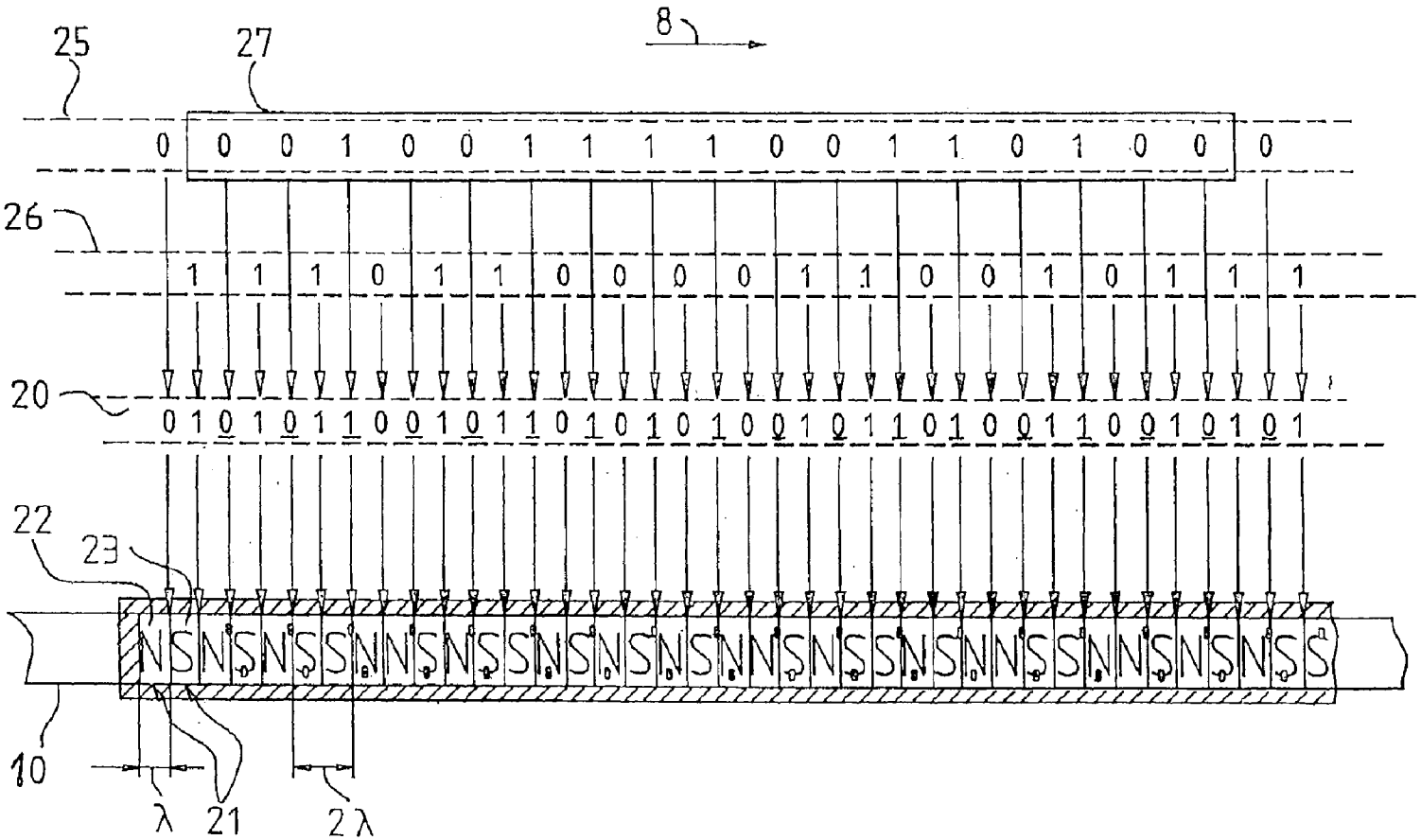
FIG. 3 shows the sequence of arrangement of the individual bits on the magnetic strip in the combined code mark pattern shown in FIG. 2.

The sequence of arrangement of the individual bits in the combined code mark pattern 20 is shown in FIG. 3. There, too, the individual pole transitions 24 are replaced by the respective corresponding bits of the coding. The coding according to the present invention is built-up from a binary pseudo-random sequence 25 which is known per se and which is combined with its inverted counterpart 26.

A pseudo-random sequence consists of bit sequences, which are arranged gaplessly one after the other, with "n" binary digits. On each movement forward by one bit in the binary pseudo-random sequence, then, as is known, a new n-digit binary bit sequence arises each time. Such a sequence "n" of bits disposed one after the other is termed a code word in the following description. The code words of a binary pseudo-random coding can, as is known, be produced with the help of a linear feedback shift register. The number of digits of the shift register in that case corresponds with the number of digits of the binary bit sequence or of the code word. In general, in an "m" bit pseudo-random coding, "n=xexp (m)" different code words can be differentiated, wherein "x" is the significance of the code word number and "m" is the number of digits or bits of the code word. The greatest number which can be represented results at "N=xexp (m)−1". The greater the number of bits, the more code words can be differentiated from one another.

The embodiment of the invention illustrated in FIG. 3 is based on the pseudo-random sequence 25 of code words 27 with "n=17 digits". It is "2exp (17)−1" bits long and consequently consists in total of "n=2exp (17)=131,072" different ones of the code words 27. According to the present invention, in the travel direction 8 of the described pseudo-random sequence 25 a bit with the significance "1" is inserted after each bit with the significance "0", and a "0" bit of the inverse pseudo-random sequence is inserted after each "1" bit. Consequently, a bit change takes place in the single-track, combined code mark pattern 20 at the latest after two bits. According to FIG. 3 this appears on the magnetic strip 10 in that only the magnetic poles 22, 23 in the travel direction 8 "L=four mm" and the double length "L=2λ=8 mm" are present and that the transition 24 from one of the north poles 22 to one of the south poles 23 or conversely occurs at the most after "L=2λ=eight mm".

The "n1=2exp (17)−1" bits of the pseudo-random sequence 25 and the "n2=2exp (17)−1" bits inverse thereto of the inverted counterpart 26 are summated to form the total "nK=2x(2exp (17)−1)" bits. This corresponds in the case of the code mark length "λ=4 mm" selected here to a geometric overall length of the single-track, combined code mark pattern 20 of "Lmax=nK*8=262,144*4 mm=1048.576 m".

Considered analytically, the combination yields a combined code mark pattern 20 in which in total "NK=2 (2exp (17)−1)−36=2exp (18)−2−36=262,106" code words now with, in each instance, eighteen digits are differentiated. Thus, the combination according to the present invention yields, apart from doubling the number of bits or magnetic poles 22, 23, also a code digit gain. Consequently, with simultaneous scanning of each eighteen successive ones of the respective second bits of the combined code mark pattern 20 an unambiguous 18-digit read pattern 33 (FIG. 2) is thus read off without repetition of code words.

Figure 4:
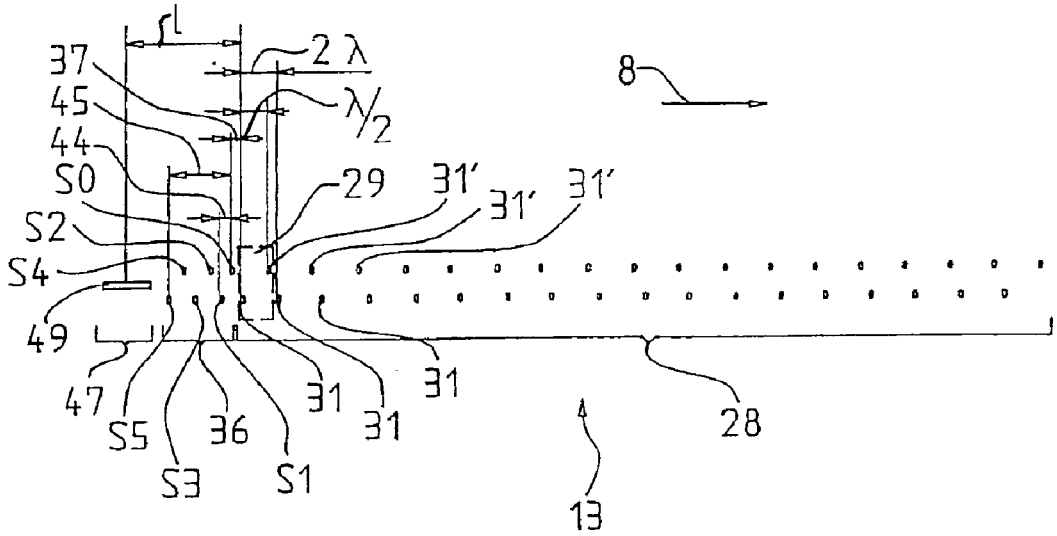
FIG. 4 is a schematic illustration of a variation of the code reading pairs of the code reading sensor system shown in FIG. 2.

Correspondingly, the code reading sensor system 11 according to FIG. 2 for reading the eighteen-bit position code or code word 33 comprises a position code reading device 28 with eighteen sensor pairs 29, which is illustrated more specifically in FIG. 4. The sensor pairs 29 are arranged in the travel direction 8 on a line at a spacing which corresponds with the length "2λ=8 mm" of two of the magnetic poles 22, 23. Two sensors 31, 31' of each of the sensor pairs 29 are separated by a mutual spacing 37 of the size of a half code mark length "λ/2=2 mm". If one of the two sensors 31, 31' is disposed in the vicinity of a magnetic pole change 24 (FIG. 2) and delivers a sensor voltage of approximately the value zero, then the respective other sensor 31, 31' of the pair is disposed with certainty in coincidence with one of the magnetic poles 22, 23 and delivers reliable information. All eighteen first sensors 31 are combined into a first sensor group and all eighteen second sensors 31' are combined into a second sensor group. Of the sensors 31 of the first sensor group and of the sensors 31'—which are offset by half the code mark length "λ/2=2 mm" in the travel direction 8 —of the second sensor group, alternately always only the output signals of the sensors of one of the two sensor groups for positional reading are selected and evaluated. The read-off pattern 33 of the position code reading device 28 of FIG. 2 is thus composed of eighteen simultaneously read bits, wherein, however, only each second bit of the combined code mark pattern 20 is read.

The eighteen bits, which in described manner are simultaneously read off by the position code reading device 28, of the read-off pattern 33 are interpreted by the evaluating unit 17 (FIG. 2) in common as an eighteen-digit code word. An absolute position value 35 of the elevator car 2, which is issued as a binary number in correct sequence, is unambiguously associated with each of these "n=2 *(2exp (17)−1)−36=262,106" eighteen-digit code words of the combined code mark pattern 20 by way of a translation or decoding table stored in a fixed value store, here an EPROM. The resolution of the position code reading device 28 is here "4 mm", which corresponds with the length "λ" of the code mark 21.

The switching over to the respective correct one of the two sensor groups of the position code reading device 28 takes place by way of determination of the position of the pole transition 24 between the south pole 23 and the north pole 22 with the help of an interpolation device 36. The interpolation device 36 is arranged —in the travel direction 8 —either in front of, as shown in FIG. 2, or behind, as shown in FIG. 4, the position code reading device 28 at a spacing of an integral number multiple of the length "λ=4 mm" of the code mark 21. The interpolation device 36 comprises a group of six Hall sensors S0 to S5, which are placed one behind the other in the travel direction 8 at a spacing 44 in each instance of "λ/2=2 mm", so that a spacing 45 of "10 mm" accordingly separates the first Hall sensor S0 and the last Hall sensor S5. A zero position, i.e. the pole transition 24 of the above-described combined code mark pattern 20, is necessarily disposed in the region between the first Hall sensor S0 and the last Hall sensor S5. The interpolation reading device 36 detects the quasi-equidistant pole transitions 24, which are created in accordance with the present invention, or zero transitions of the magnetic field between two successive ones of the north poles 22 or the south poles 23.

Figure 5:
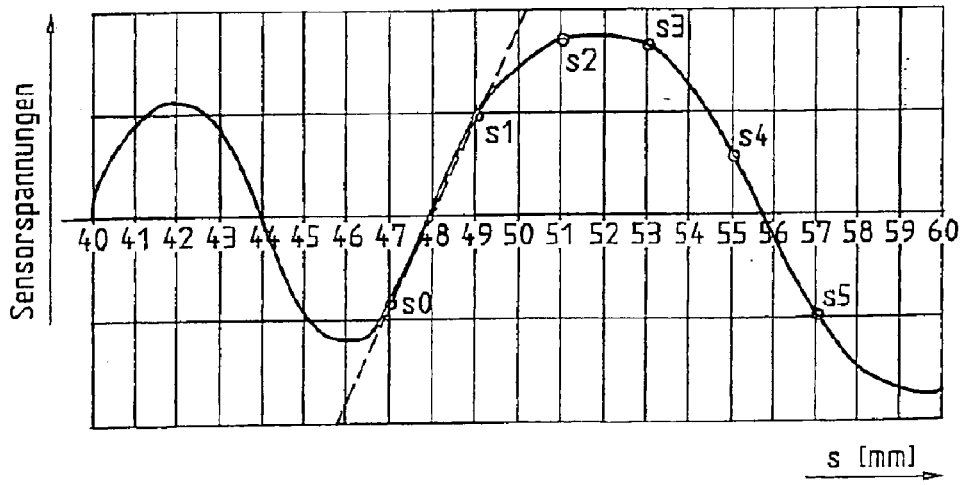
FIG. 5 is a waveform diagram showing an output signal generated by the interpolation unit shown in FIG. 2.

An example of the output voltage of the six Hall sensors S0 to S5 of the interpolation device 36 over the travel in the travel direction 8 at millimeter intervals is illustrated in FIG. 5. Sufficiently known comparator circuits undertake the following comparisons of the voltages of the individual sensors S0 to S5, which are weighted as follows:

| | |
|---|---|
| U(S0) > 0 | ->0 |
| U(S0) + 1/3 * U(S1) > 0 | ->0 |
| U(S0) + U(S1) > 0 | ->1 |
| 1/3 * U(S0) + U(S1) > 0 | ->1 |
| U(S1) > 0 | ->1 |
| etc., up to: | |
| U(S4) + 1/3 * U(S5) | ->1 |

This gives, for the example illustrated in FIG. 5, the numerical sequence: "001111111111111111". It is thus expressed that one of the south poles 23 extends at the first interpolation sensor S0 up to "0.5 mm" therebehind. One of the north poles 22 is disposed from "1.0 mm" to "9 mm" behind the first interpolation sensor S0.

The produced number sequence is decoded by way of a table, which for example is stored in an EPROM, into a three-digit binary number sequence which represents an interpolation value which, in the case of the example, is "3 mm". This is periodic with the code mark length "λ" and indicates the polarity of the strip, calculated from the position of the first Hall sensor S0, in steps of, for example, "0.5 mm". The peak value bit of this interpolation value signal 46 (FIG. 2) inverts at an interval of "2 mm" (transition 24) and takes over, as a scanning signal, that for the described switching over between the sensors 31 and 31' of the position code reading device 28.

The three bits of the interpolation value 46 are additionally included in the overall positional information 53. The voltages of the Hall sensors S0 to S5 now only have to be compared with the threshold for "0 mT", for which purpose a comparator is provided for each of the six Hall sensors S0 to S5 of the position code reading device 28. From the digital bits resulting therefrom, the correct bits are selected by way of a number of two-to-one multiplexers, which are controlled by the "2 mm" bit of the interpolation device 36. All that is still needed is a synchronization pulse which can amount to several hundred kHz. The position value is generated after a pulse cycle (<10 ns).

The single-track measuring system described to that extent can be built up with very economic components. It enables high travel speeds of more than sixteen m/s. The measuring rate is dependent virtually only on the speed of the interface. The system resolution of this absolute single-track system is "0.5 mm", but can be substantially increased by additional use of a fine interpolation device 47 (FIGS. 2 and 4).

The fine interpolation unit 47 scans, additionally to the Hall sensors 31, 31', S0 to S5, the combined code mark pattern 20 by an MR sensor 49 (magnetoresistive or inductive resistance sensor). The MR angle sensor 49 is arranged at the code reading device 12 at a fixed spacing "1=kλ" (FIG. 4), which corresponds with a multiple of the length of the code mark 21, in front of the interpolation device 36 in the travel direction 8 in the case of the embodiment according to FIG. 2 and behind the interpolation device 36 in the travel direction 8 in the embodiment according to FIG. 4 and is moved together therewith relatively along the magnetic strip 10. In that case the MR angle sensor 49 detects the path of the magnetic field of the single-track, combined code mark pattern 20, which is composed of approximately sinusoidal half-waves of the length "λ=4 mm" or "2λ=8 mm" of the magnetic fields formed by the north poles 22 and the south poles 23.

Figure 6:
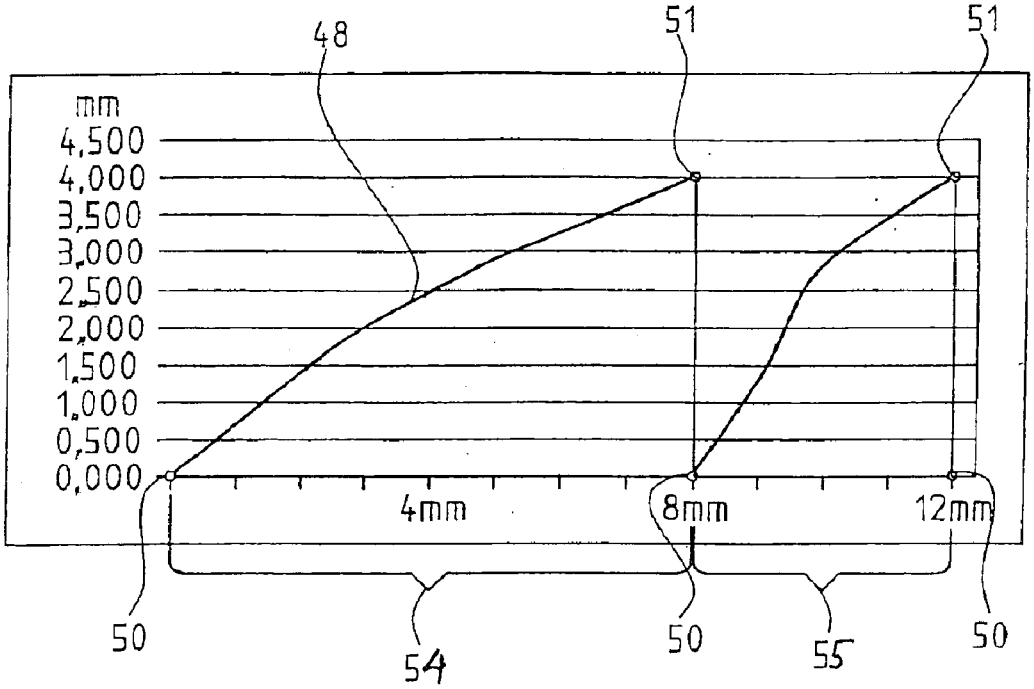
FIG. 6 is a waveform diagram showing an output signal of an MR angle sensor of the fine interpolation unit scanning of the magnetic field along the coded magnetic strip shown in FIG. 3.

FIG. 6 shows the waveform of an output signal 48 of the MR angle sensor 49, which sensor can be a model LK28 available from IMO, for scanning the half waves of the combined code mark pattern 20, recorded along the path in the travel direction 8. The sine-shaped and cosine-shaped output voltages of the MR sensor 49 are already arc-tangent interpolated by means of an interpolator chip or by software (not illustrated) in the microcontroller and so standardized that a minimum value 50 lies at "0 mm" and a maximum value 51 at "4 mm". The output signal 48 yields high-resolution positional information 52 (FIG. 2) which is travel-proportional within the length "λ=4 mm" of one of the north poles 22 or south poles 23, or "2λ=8 mm" of two mutually adjacent magnetic poles of like sign.

It can be inferred from the shape of the output signal 48 of the MR angle sensor 49 that there is an "8 mm" magnetic pole in a region 54 between "0 mm" and "8 mm", and a "4 mm" magnetic pole in a region 55 between "8 mm" and "12 mm".

This high-resolution positional information is further processed as follows:

If the MR angle sensor 49 is disposed above a "4 mm" magnetic pole then the interpolated positional information of the fine interpolation device 47 is taken over as the high-resolution position value 52. If the MR sensor 49 is disposed above an "8 mm" pole, then the interpolated positional information is multiplied by "2". If the value resulting therefrom is greater than the maximum value here predetermined by the length "λ=4 mm" of a magnetic pole, then the maximum value 51 is subtracted.

From this calculation rule there results the position value 52, which is periodic with the code mark length "λ", with a resolution in the order of magnitude of "50 μm", such as was previously obtained only from the incremental track of a conventional double-track system.

The information whether the MR angle sensor 49 is disposed above a "4 mm" or above an "8 mm" magnetic pole can be filed in the decoding table. Initially the code word 33 is determined by the position code reading device 28, and by way of the address —which is indicated by the code word 33 —of the decoding table not only the absolute position 35, but also the arrangement of the magnetic pole under the instantaneous position of the MR angle sensor 49 are read out.

For calculation of a high-resolution overall position 53 (FIG. 2) the periodic high-resolution position values 52 determined by the fine interpolation device 47 and the absolute position value 35 of the resolution "λ=4 mm" determined by the position code reading device 28 are synchronized with one another in a microcontroller 40. This is possible in a problem-free manner, since the absolute position 35 is available, as previously described, with a resolution of "0.5 mm".

The calculation of the high-resolution overall position 53, which consists of in total twenty-four bits, of the elevator car 2 can be carried out very quickly, since only a few simple operations, for example comparisons, bit displacements, additions and subtractions, are necessary.

The high travel speed possible by way of the coding according to the present invention and the position code reading device 28 is not prejudiced by the fine interpolation device 47 if an interpolator chip with parallel output of the interpolated positional information is used and if the high-resolution position value 52 is intermediately stored, controlled by the synchronization pulse, synchronously with the absolute position value 35.

The distortions, which are recognizable in FIG. 6, of the waveform 48 of the interpolated position value obtained by fine interpolation can be undistorted by an undistorting table respectively for "4 mm" and "8 mm" magnetic poles, whereby accuracy is substantially improved. This is possible because the distortions of magnetic poles of like length "λ" or "2λ" are closely similar at all positions of the combined code mark pattern 20.

Figure 7:
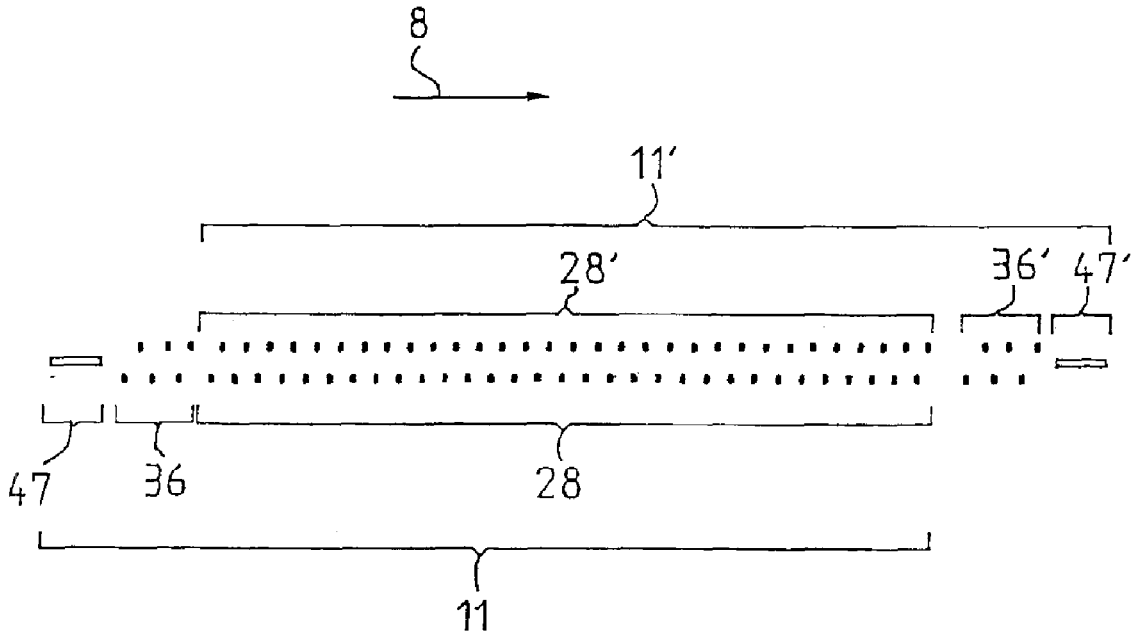
FIG. 7 is a schematic illustration of a second variation of the code reading pairs of the code reading sensor system shown in FIG. 2.

In FIG. 7 there is illustrated an embodiment of the present invention in which the code reading sensor system 11 is constructed in a redundant manner. A second code reading sensor system 11' is constructed in basically the same manner as the code reading sensor system 11 in the previously described first embodiment according to FIG. 4. By contrast to the first embodiment of the code reading sensor system 11, in the case of the second code reading sensor system 11' an interpolation device 36' and a fine interpolation device 47' are arranged in this sequence in the travel direction 8 in front of the position code reading device 28.

The second code reading sensor system 11' is placed in mirror symmetry relative to the first code reading sensor system 11, wherein sensor pairs 29, 29' of the two position code reading devices 28, 28' interengage in a line, parallel to the travel/reading direction 8 and are offset relative to one another by a code mark length "λ=4 mm". In this position the eighteen sensor pairs 29' of the second position code reading device 28' detect a read-off pattern 33 of eighteen of the respective first bits of the combined code mark pattern 20.

Figure 8:
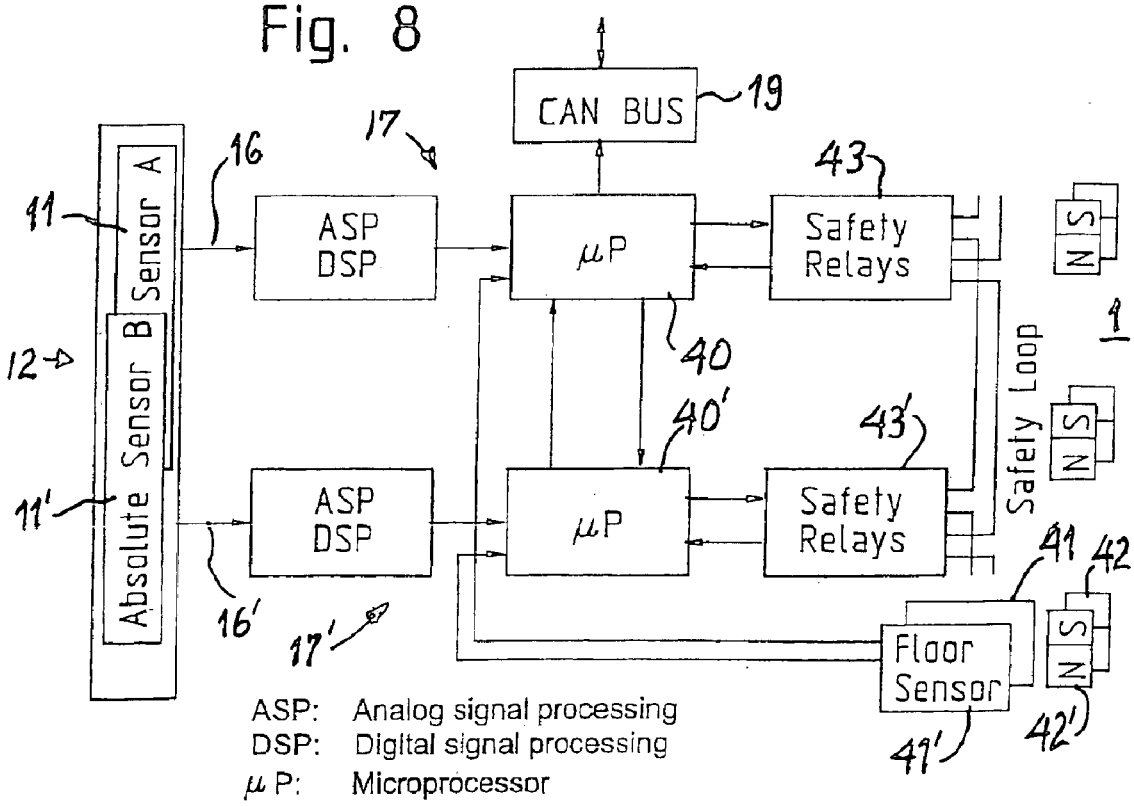
FIG. 8 is a schematic block diagram of a redundant construction of the measurement system as the basis of a comprehensive shaft information system according to the present invention.

As FIG. 8 shows, a respective evaluating unit 17, 17' is associated with each of the two code reading sensor systems 11, 11', so that the output signals of the sensors of the two code reading sensor systems 11, 11' are evaluated independently of one another, and two high-resolution values —which are determined independently of one another —of the overall position 53 are available as a binary number with twenty-four digits for control of the elevator.

A comprehensive shaft information system with numerous functions can thus be obtained, in co-operation with an additional elevator sensor system, starting from the redundancy, which is created in accordance with the present invention, of the absolute measuring system for determining the absolute car position.

Examples of such functions, which proceed from determination of the absolute car position, of a shaft information system are: the shaft end deceleration, shaft end limitation, floor recognition, level compensation, door bridging over as well as the most diverse travel regulations and much more.

FIG. 8 shows a construction, in the redundant manner, of the single-track measuring system as the basis of a shaft information system. The redundant construction of the single-track measuring system is, together with a respective floor sensor 41, 41', the basis of a comprehensive shaft information system schematically illustrated in FIG. 8. One of the floor sensors 41, 41' is associated with each of the evaluating units 17, 17'. The floor sensors 41, 41' are moved in the shaft 1 together with the elevator car 2 in order to detect position markings 42, 42' arranged in the shaft 1 at each floor level. The signals of the floor sensors 41, 41' are processed together with the output signals of safety devices 43, 43', which are similarly provided in redundant form, in common with the positional information 53 and serve for control of the elevator.

The length code mark pattern 20 of the magnetic strip 10 is, in this embodiment, represented by differently poled magnetized sections and is read off by means of sensors 31, 31', S0 to S5, which are sensitive to magnetic fields, of the code reading device 12. Fundamentally, other physical principles for representation of the length coding are also conceivable. Thus, the code marks can also have different dielectric numbers, which are read by sensors detecting capacitive effects. Moreover, a reflective code mark pattern is possible in which, depending on the respective significance of the individual code marks, a greater or lesser amount of light is reflected from an illuminating device to reflected-light barriers as sensors.

The invention enables the use of economic Hall sensors for reading the position code. In principle, however, a realization with more costly induction transmitters, i.e. so-termed GMR sensors or magnetoresistive sensors detecting magnetic field direction, i.e. so-termed MR sensors, is also possible. Of each of these sensors, several individual sensors and/or a group of different sensors can be present in combination with one another at a code reading device.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A position measuring system for an elevator installation for determining a position of an elevator car movable along at least one guide rail, comprising:

a strip having a code mark pattern and adapted to be mounted near the elevator car and parallel to a travel direction of the elevator car;

a code reading device adapted to be mounted on the elevator car for contactless scanning of said code mark pattern; and an evaluating unit connected to said code reading device for evaluating said scanned code mark pattern, wherein "n" successive code marks of said code mark pattern form a code word, a plurality of different ones of said code words are unambiguously arranged in an n-digit pseudo random sequence, said code words form a single-track of said code mark pattern and that each said code word represents an absolute car position.

2. The position measuring system according to claim 1 wherein said code marks form magnetic poles and said code reading device includes a plurality of Hall sensors for detecting said magnetic poles.

3. The position measuring system according to claim 1 wherein said code reading device includes a plurality of sensors for simultaneous scanning of said code marks of each of said code words.

4. The position measuring system according to claim 3 wherein said evaluating unit compares a voltage generated by said sensors with a threshold value.

5. The position measuring system according to claim 1 wherein said code reading device includes a plurality of sensors for detecting code mark transitions, said transitions being arranged in the travel direction over a region of said magnetic strip with a length greater than a length (2λ) of two of said code marks and at a spacing smaller than the length (λ) of one of said code marks.

6. The position measuring system according to claim 1 wherein said code reading device detects at least one transition between said code marks.

7. The position measuring system according to claim 1 wherein said code reading device scans said code marks with a resolution of the absolute car position corresponding a length of said code marks.

8. The position measuring system according to claim 1 wherein said code reading device detects transitions between said code marks and scans said code marks with a resolution of the absolute car position of approximately 0.5 mm.

9. The position measuring system according to claim 1 including at least one floor sensor mounted adapted to be mounted on the elevator car for detecting position markings at floor levels along the travel direction, said at least one floor sensor being connected to said evaluating unit, said evaluating unit evaluating said detected position markings against said scanned code words.

10. The position measuring system according to claim 1 wherein said code reading device is constructed in a redundant manner.

11. The position measuring system according to claim 1 wherein said code mark pattern is coded in Manchester coding, wherein each said code mark is combined with an adjoining inverted code mark.

12. The position measuring system according to claim 1 wherein said strip is adapted to be mounted at the at least one guide rail.

13. The position measuring system according to claim 1 wherein said code measuring device includes a plurality of sensors arranged in a line parallel to the travel direction.

14. The position measuring system according to claim 1 wherein said code marks form magnetic poles, said code reading device includes a sensor for detecting a course of a magnetic field of said code mark pattern, and said evaluating unit includes a fine interpolation unit for interpolating said course of said magnetic field in an arc-tangential manner and for generating a high-resolution position value periodic with a length of said code marks.

15. A position measuring system for an elevator installation for determining a position of an elevator car movable along at least one guide rail, comprising:

a strip having a code mark pattern and adapted to be mounted near the elevator car and parallel to a travel direction of the elevator car;

a pair of code reading devices adapted to be mounted on the elevator car for contactless scanning of said code mark pattern; and a pair of evaluating units each connected to a respective one of said code reading devices for evaluating said scanned code mark pattern, wherein "n" successive code marks of said code mark pattern form a code word, a plurality of different ones of said code words are unambiguously arranged in an n-digit pseudo random sequence, said code words form a single-track of said code mark pattern and that each said code word represents an absolute car position.

16. The position measuring system according to claim 15 including at least one floor sensor mounted adapted to be mounted on the elevator car for detecting position markings at floor levels along the travel direction, said at least one floor sensor being connected to said evaluating units, said evaluating units evaluating said detected position markings against said scanned code words.

* * * * *